US011814213B2

(12) United States Patent
Hall et al.

(10) Patent No.: US 11,814,213 B2
(45) Date of Patent: Nov. 14, 2023

(54) STORAGE APPARATUS HAVING STACKABLE NESTED BINS

(71) Applicant: Buddeez, Inc., Wentzville, MO (US)

(72) Inventors: Charles E Hall, Wentzville, MO (US); William A Hall, Dardenne Prairie, MO (US); Steven C Hall, Lake St. Louis, MO (US); Matthew W Hall, Wentzville, MO (US)

(73) Assignee: Buddeez, Inc, Wentzville, MO (US)

( * ) Notice: Subject to any disclaimer, the term of this patent is extended or adjusted under 35 U.S.C. 154(b) by 0 days.

(21) Appl. No.: 17/560,674

(22) Filed: Dec. 23, 2021

(65) Prior Publication Data

US 2023/0202712 A1 Jun. 29, 2023

(51) Int. Cl.
*B65D 21/02* (2006.01)
*B65D 1/22* (2006.01)
*B65D 25/32* (2006.01)

(52) U.S. Cl.
CPC ..... *B65D 21/0224* (2013.01); *B65D 1/22* (2013.01); *B65D 21/0233* (2013.01); *B65D 25/32* (2013.01)

(58) Field of Classification Search
CPC .. A47F 1/14; B42F 7/12; B65D 21/00; B65D 21/0209; B65D 21/0211; B65D 21/0215; B65D 21/0219; B65D 21/0224; B65D 21/0233; B65D 21/0234; B65D 21/0235; B65D 21/2015; B65D 21/21; B65D 55/16; B65D 85/62; B65D 1/22; B65D 11/1846; B65D 11/1893; B65D 17/4012; B65D 19/44; B65D 21/0216; B65D 2251/1058; B65D 23/102; B65D 25/00; B65D 25/02; B65D 25/04; B65D 25/10; B65D 25/101; B65D 25/14; B65D 25/20; B65D 25/38; B65D 25/52; B65D 2519/00174; B65D 2519/00323; B65D 2519/00666; B65D 2543/00101; B65D 2543/00296; B65D 2543/00388; B65D 2543/0049; B65D 2543/00546; B65D 2543/00629; B65D 2543/00703; B65D 2543/0074; B65D 2543/00814; B65D 2543/00842; B65D 2590/547; B65D 2590/664; B65D 2590/668; B65D 43/16; B65D 43/24; B65D 5/4208; B65D 51/2828; B65D 51/2835; B65D 73/02; B65D 81/03; B65D 81/07; B65D 81/18; B65D 81/263; B65D 83/00; B65D 85/48; B65D 85/50; B65D 85/68; B65D 85/72; B65D 88/02; B65D 88/10; B65D 88/16; B65D 88/26; B65D 88/28;

(Continued)

(56) References Cited

U.S. PATENT DOCUMENTS

2012/0132558 A1* 5/2012 Busch ..... B65D 21/062 206/503
2012/0138617 A1 6/2012 Dubois et al.
2019/0059321 A1* 2/2019 Casale ..... B65D 43/165

* cited by examiner

*Primary Examiner* — Anthony D Stashick
*Assistant Examiner* — Marcos Javier Rodriguez Molina
(74) *Attorney, Agent, or Firm* — Sandberg Phoenix & von Gontard PC

(57) ABSTRACT

A storage apparatus has first and second bins with configurations that match. The bins have movable supports that enable the bins to be stacked on each other and attached to each other when employing the bins to store items in the bins and move the items from one area to another by moving the attached bins. The first and second bins are also nestable together to store the bins in a minimum of storage space when the bins are not in use.

20 Claims, 9 Drawing Sheets

(58) Field of Classification Search
CPC ..... B65D 88/32; B65D 88/54; B65D 88/546; B65D 88/62; B65D 88/64; B65D 88/66; B65D 88/68; B65D 88/72; B65D 88/76; B65D 90/00; B65D 90/046; B65D 90/10; B65D 90/12; B65D 90/205; B65D 90/26; B65D 90/34; B65D 90/48; B65D 90/54; B65D 90/623; B65D 90/66
USPC ..... 206/499, 503, 505, 506, 507, 509, 511, 206/512, 585, 821; 220/23.2, 23.6, 23.8, 220/379, 4.26, 4.27, 427, 744, 781, 232, 220/236, 238, 426
See application file for complete search history.

STORAGE APPARATUS HAVING STACKABLE NESTED BINS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

Storage apparatus that employ bins for storing hardware and other items are at times inconvenient to use. When two or more bins are needed to store items and it is necessary to move the items from one area to another area, it is often difficult for an individual to hold the two or more bins while moving the bins from area to area.

Additionally, when the bins are not being used for storing items, the empty bins take up storage space. When storage space is limited, the empty bins in the storage space are an inefficient use of the limited storage space.

BRIEF SUMMARY

The storage apparatus of this disclosure having stackable nested bins overcomes the above-described inconveniences of known storage apparatus that employ bins.

The storage apparatus of this disclosure has multiple bins, for example a first bin and a second bin. The storage apparatus could have a third bin or more bins. In the apparatus having a first bin and a second bin, the first bin and the second bin have configurations that match.

The first bin has a base and at least one wall extending upward from the base and around an interior volume of the first bin. The at least one wall could include a front wall and an opposite back wall extending upward from the base, and a first sidewall and an opposite second sidewall extending upward from the base.

In a like manner, the second bin has a base and at least one wall extending upward from the base and around an interior volume of the second bin. The at least one wall could include a front wall and an opposite back wall extending upward from the base of the second bin, and a first sidewall and an opposite second sidewall extending upward from the base of the second bin.

There is a support on the first bin, for example a first support on the first bin. The first support on the first bin can be alternatively positioned on the first bin in at least a first position of the first support on the first bin and a second position of the first support on the first bin. The first support could be positioned stationary at the first and second positions on the first bin. The first support is movable on the first bin. For example, the first support is rotatable on the first bin between the first position of the first support on the first bin and the second position of the first support on the first bin. In the first position of the first support on the first bin the first support and the first bin are aligned and are insertable together into the interior volume of the second bin. In the second position of the first support on the first bin the support and bin are transverse and the first support is engageable on top of the at least one wall of the second bin or on top of the first sidewall and second sidewall of the second bin to support the first bin on top of the second bin.

There is a second support on the second bin. The second support on the second bin can be alternatively positioned on the second bin in at least a first position of the second support on the second bin and a second position of the second support on the second bin. The second support could be positioned stationary at the first and second positions on the second bin. The second support is movable on the second bin. For example, the second support is rotatable on the second bin between the first position of the second support on the second bin and the second position of the second support on the second bin.

Like the first support, in the first position of the second support on the second bin the second support and the second bin are aligned and are insertable into the interior volume of the first bin. In the second position of the second support on the second bin, the support and bin are transverse and the second support is engageable on the top of the at least one sidewall of the first bin, or on the first sidewall and second sidewall of the first bin to support the second bin on top of the first bin.

In the second position of the first support on the first bin, the first support is attachable on top of the second bin. The attachment enables the first bin and the second bin attached to the first bin to be moved together. For example, there are attachment devices that extend downward from the first support. In the second position of the first support on the first bin the attachment devices are attachable on top of the second bin to thereby attach the first bin to the second bin and enable the first bin and the second bin to be moved together.

In a like manner, in the second position of the second support on the second bin, the second support is attachable on top of the first bin. The attachment enables the second bin and the first bin attached to the second bin to be moved together. The second support has attachment devices that extend downward from the second support. The attachment devices are attachable on top of the first bin to thereby attach the second bin to the first bin and enable the first bin and the second bin to be move together.

A handle is attachable on the first bin and the second bin. The handle is movable on the first bin enabling the first bin and the second bin attached to the first bin to be moved together when the first support is attached on top of the second bin. The handle can be removed from a bottom bin when the bins are nested and when the bins are stacked.

The features, functions, and advantages of the storage apparatus having stackable nested bins that have been discussed can be achieved independently in various embodiments or maybe combined in yet other embodiments further details of which can be seen with reference to the following description and drawings.

BRIEF DESCRIPTION OF THE DRAWINGS

Corresponding reference numerals will be used throughout the several figures of the drawings.

DETAILED DESCRIPTION

Figure 1:
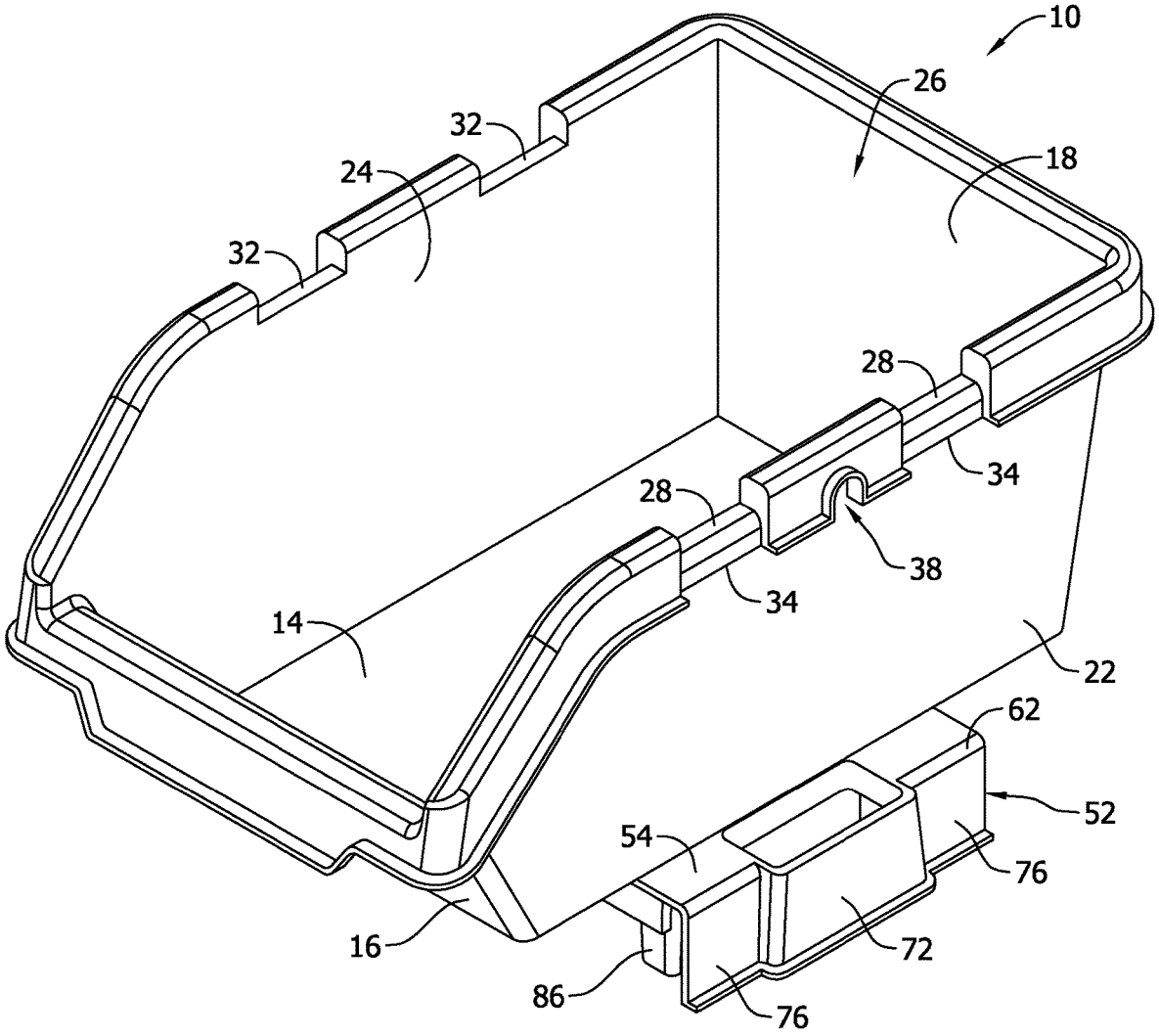
FIG. 1 is a top, front perspective view of a stackable, nestable bin of this disclosure.
Figure 2:
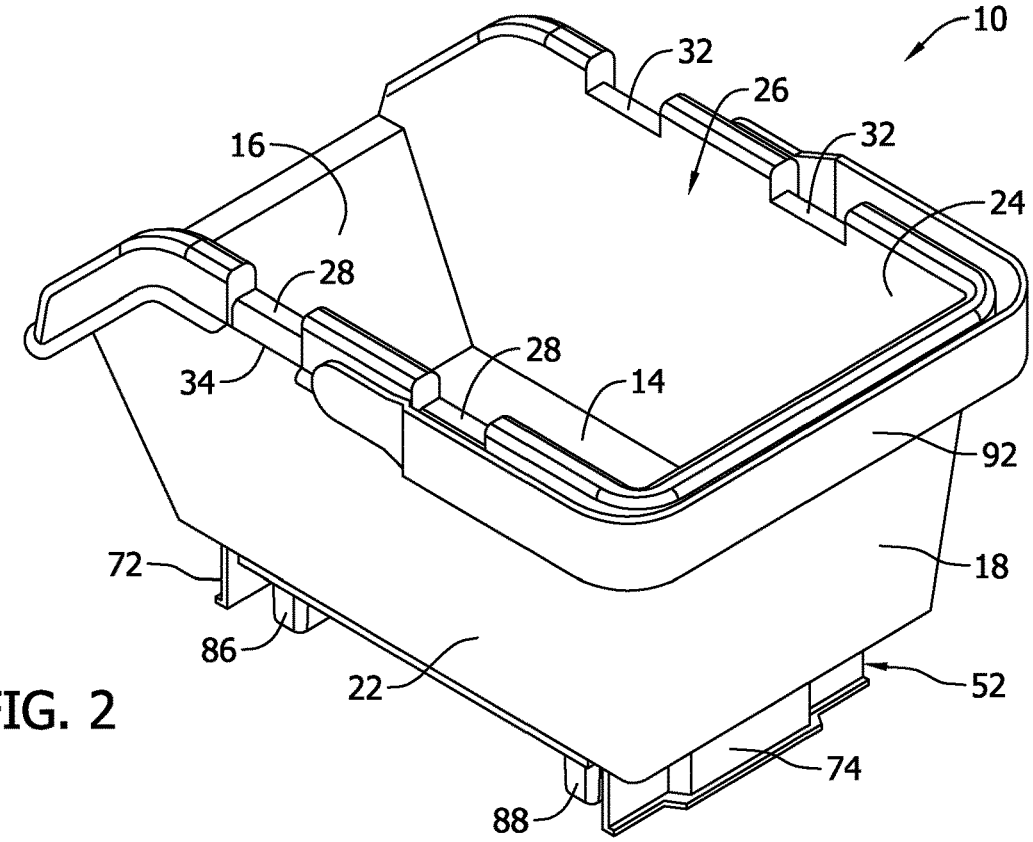
FIG. 2 is a top, rear perspective view of the bin of FIG. 1.
Figure 3:
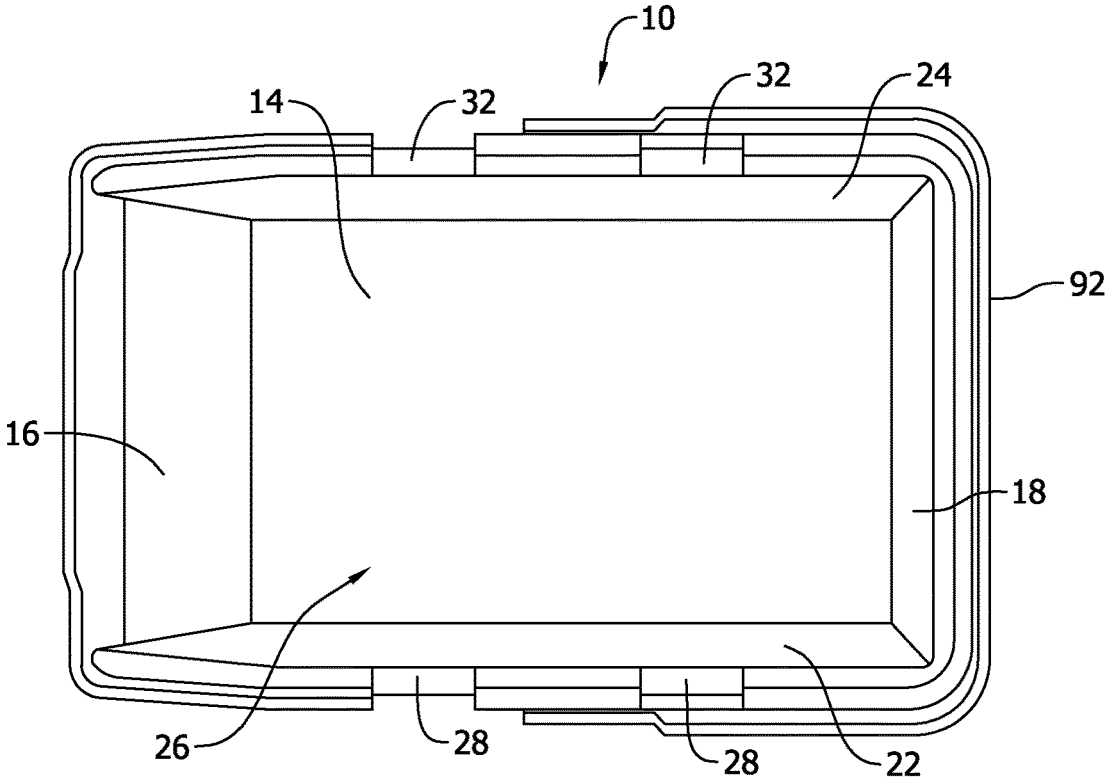
FIG. 3 is a top plan view of the bin.

The following detailed description illustrates the claimed invention by way of example and not by way of limitation. This description will clearly enable one skilled in the art to make and use the claimed invention, and describes several embodiments, adaptations, variations, alternatives and uses of the claimed invention, including what is presently believed to be the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

Figure 9:
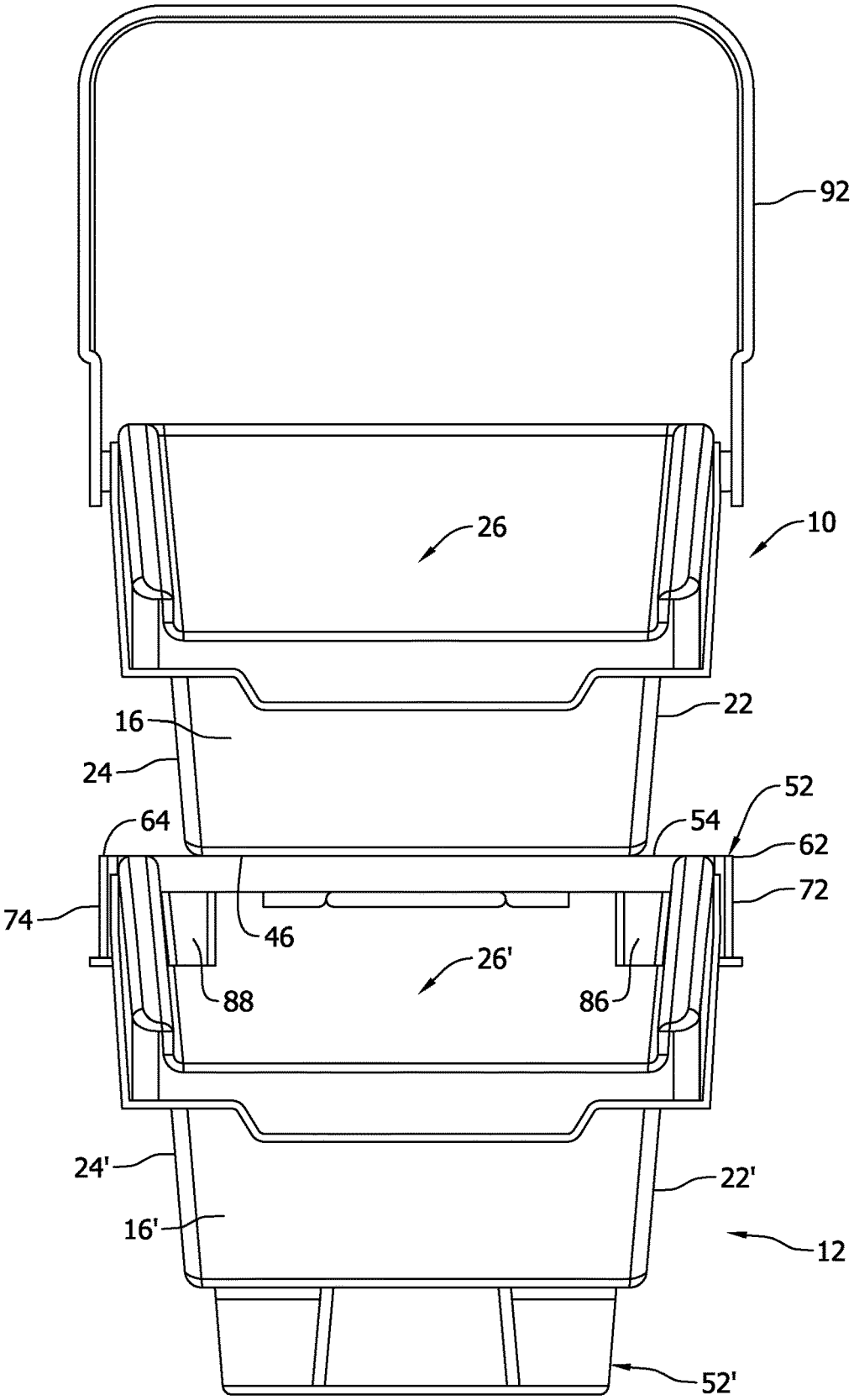
FIG. 9 is a front elevation view of a first bin stacked on and supported on a second bin.
Figure 10:
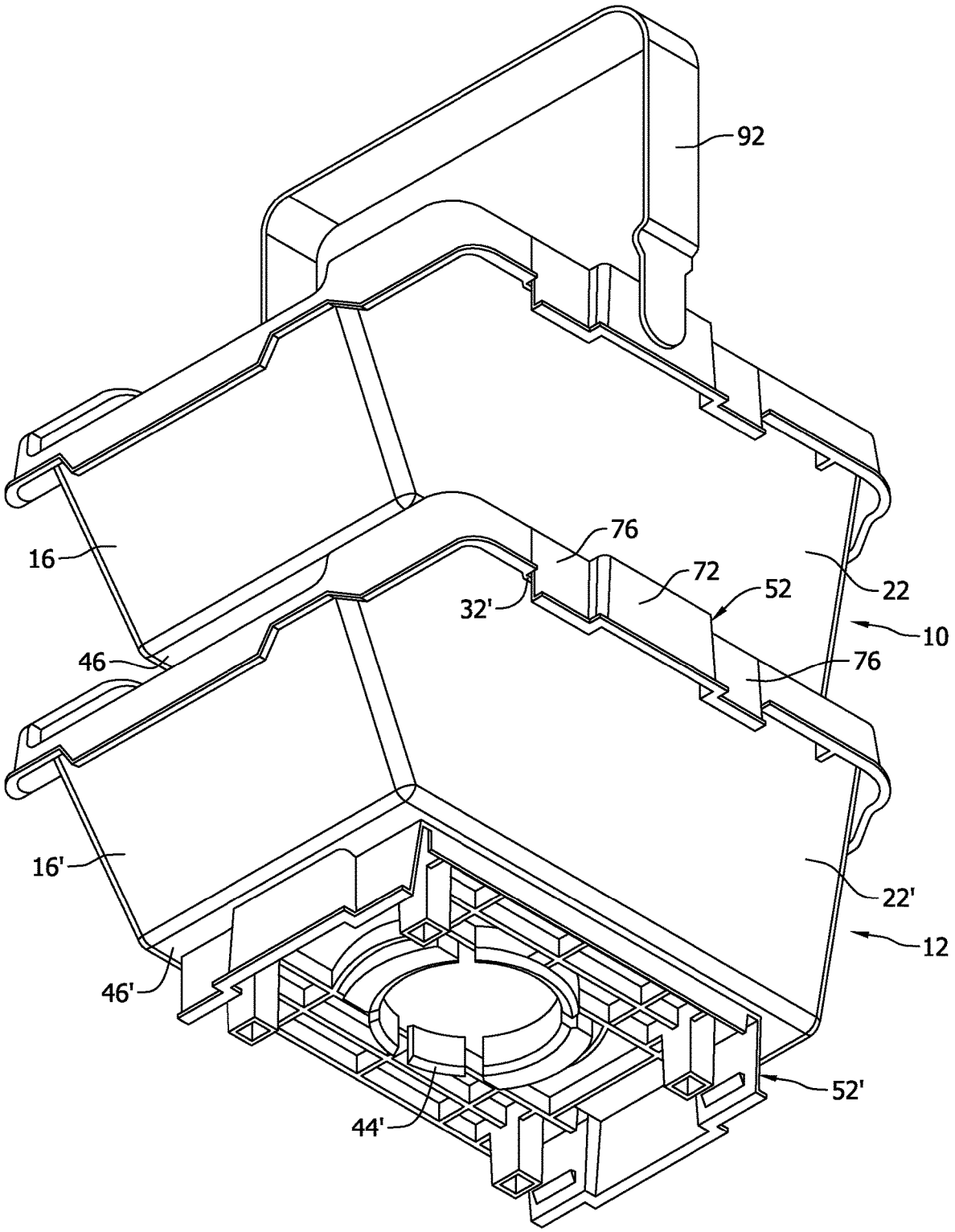
FIG. 10 is a bottom, front perspective view of the stacked bins of FIG. 9.

The storage apparatus of this disclosure is comprised of multiple bins. A first bin 10 is represented in FIGS. 1-8 and the first bin 10 and a second bin 12 are represented in FIGS. 9 and 10. It should be understood that the storage apparatus may be comprised of multiple bins, for example the storage apparatus could have the first bin 10, the second bin 12 and a third bin or more bins.

The first bin 10 and the second bin 12 have same or matching configurations as represented in FIGS. 9 and 10. The configuration of the first bin 10 is described herein. It should be understood that the description of the configuration of the first bin 10 also applies to the configuration of the second bin 12. With the first bin 10 and the second bin 12 having matching configurations, some of the reference numbers employed in labeling parts of the first bin 10 in the FIGS. are also employed in labeling parts of the second bin with the reference numbers followed by a prime (').

The bins of the storage apparatus could be constructed by molding, for example being constructed of molded plastics. The bins could be constructed of other equivalent materials and by other equivalent methods. The bins of the storage apparatus are seen as being constructed of a material that provides the bins with sufficient structural strength and with resilient flexibility to function in their intended manner.

The bin 10 has a base 14. The base 14 as a general rectangular configuration. At least one wall extends upward from a perimeter of the base 14 and around an interior volume of the bin 10. As represented in the FIGS., the at least one wall comprises a front wall 16 and an opposite back wall 18 extending upward from the base 14, and a first, right sidewall 22 and an opposite second, left side wall 24 extending upward from the base 14. The base 14, the front wall 16, the rear wall 18, the first sidewall 22 and the second sidewall 24 surround an interior volume 26 of the bin 10. The interior volume 26 is accessible through a top opening of the bin 10 defined by the front wall 16, the rear wall 18, the first sidewall 22 and the second sidewall 24.

As represented in FIGS. 1-10, the front wall 16, the rear wall 18, the first sidewall 22 and the second sidewall 24 all merge toward each other as they extend downward from the top opening of the bin 10 to the base 14 of the bin 10. This tapering of the walls enables the first bin 10 to be inserted downwardly through the top opening of the second bin 12 and into the interior volume 26' of the second bin 12 when nesting the first bin 10 into the second bin 12.

Also as represented in FIGS. 1-10, the front wall 16 does not extend upward from the base 14 to the same extent as the rear wall 18. This defines a front access opening in the front of the bin 10 above the front wall 16 that provides access to the interior volume 26 of the bin 10 when the first bin 10 and the second bin 12 are stacked, as will be explained.

There is a pair of notches 28 at the top of the first sidewall 22. There is also a pair of notches 32 at the top of the second sidewall 24. The pair of notches 28 at the top of the first sidewall 22 have bottom edges 34. The pair of notches 32 at the top of the second sidewall 24 also have bottom edges 36. The pairs of notches 28, 32 are employed when stacking the first bin 10 on top of the second bin 12 and attaching the first bin 10 to the second bin 12, as will be explained.

There is a pivot hole 38 at the top of the first sidewall 22. There is also a pivot hole 42 at the top of the second sidewall 24. The pivot holes 38,42 are employed in attaching a handle to the tops of the bins 10,12 as will be explained.

Figure 4:
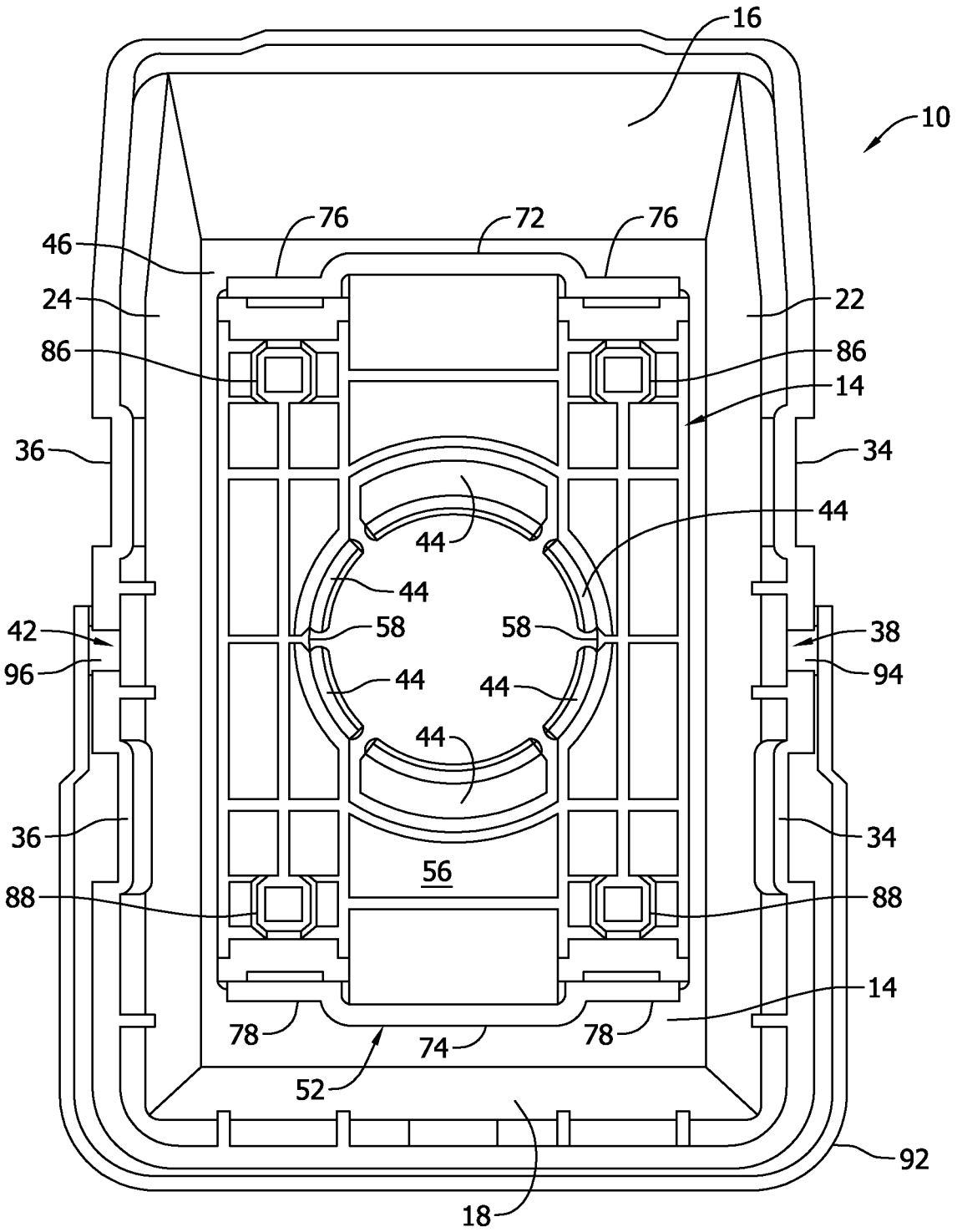
FIG. 4 is a bottom plan view of the bin.
Figure 5:
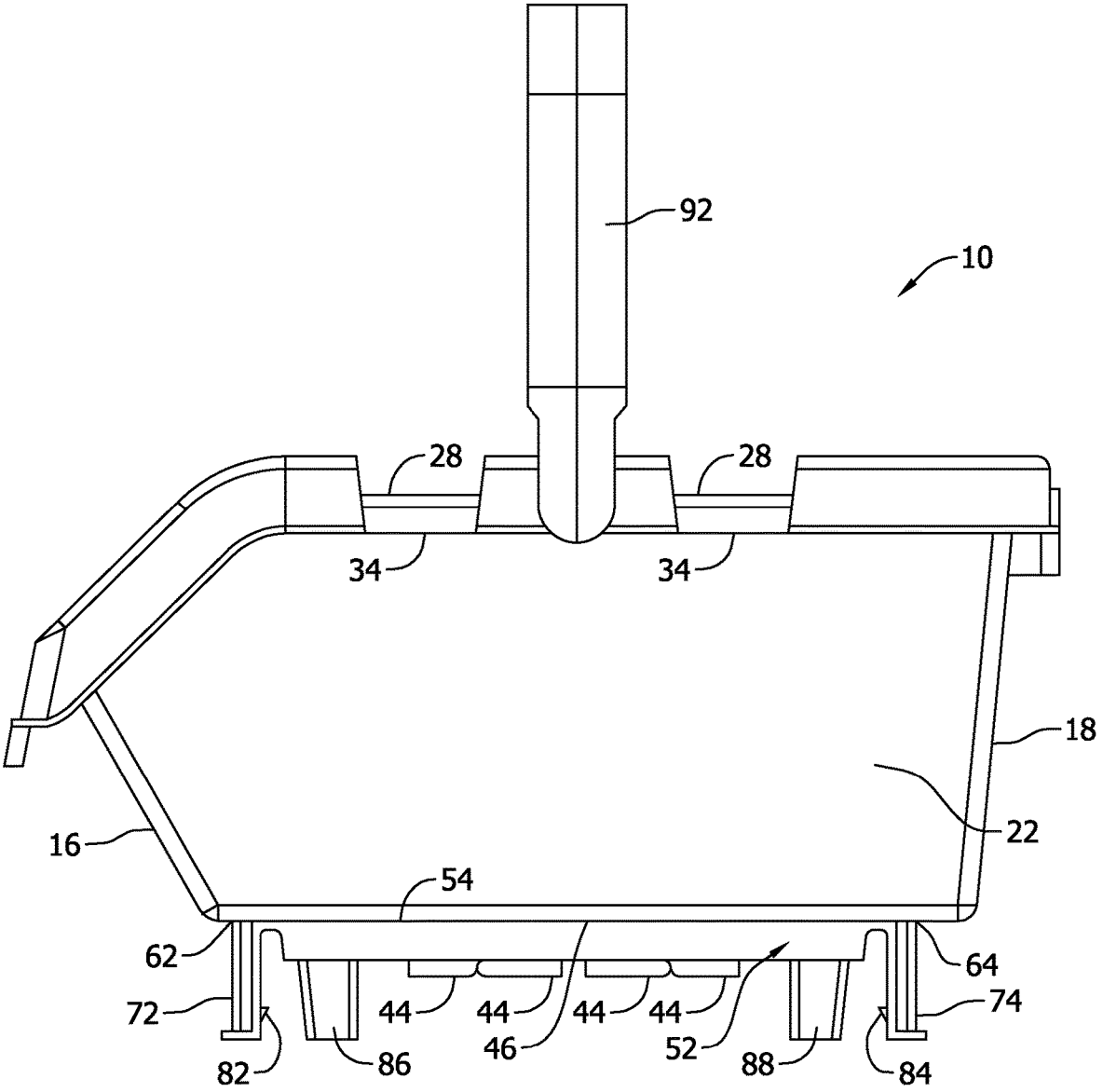
FIG. 5 is a right-side elevation view or first side elevation view of the bin, with the opposite left side or second side elevation view of the bin being a mirror image thereof.
Figure 6:
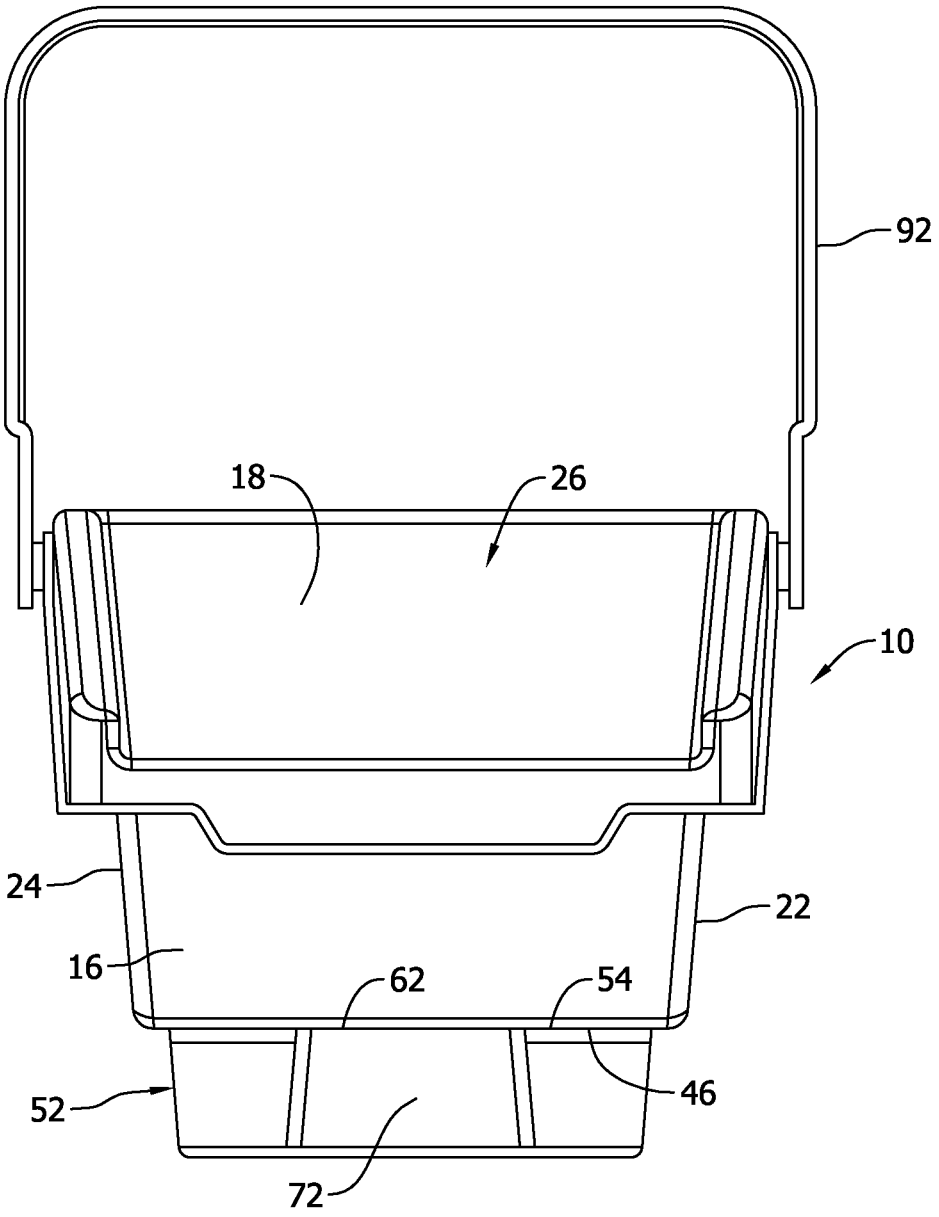
FIG. 6 is a front elevation view of the bin with a handle attached to the bin and with a support attached to the bin in a first position of the support relative to the bin.
Figure 7:
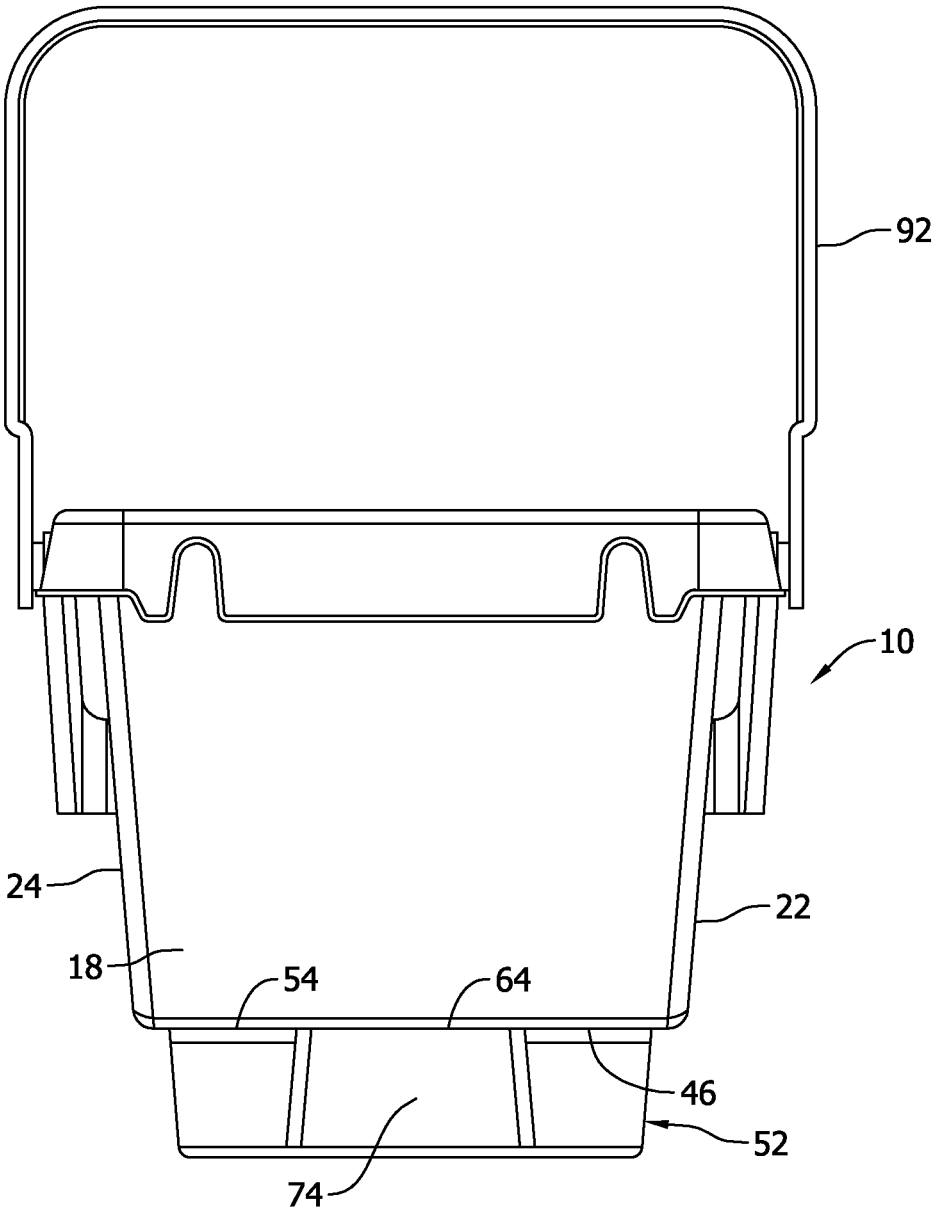
FIG. 7 is a rear elevation view of the bin of FIG. 6.
Figure 8:
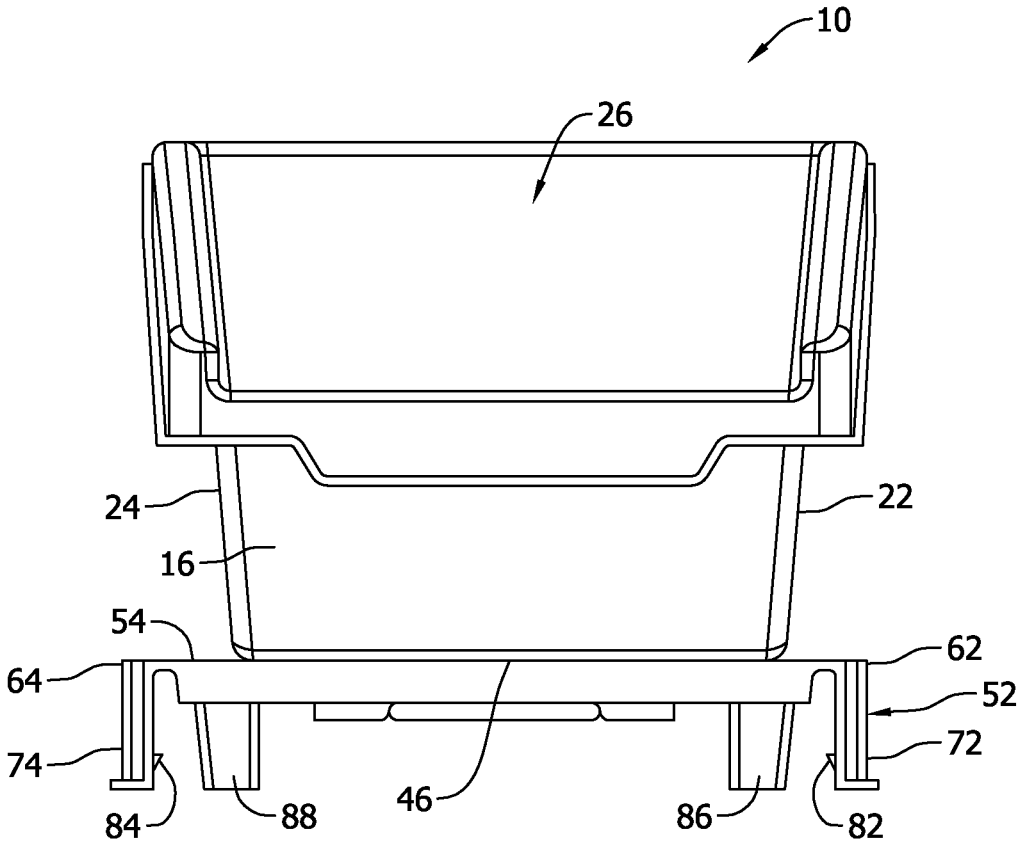
FIG. 8 is a front elevation view of the bin like FIG. 6, but with the handle removed and with the support attached to the bin in a second position of the support relative to the bin.

Arcuate flanges 44 extend downward from the bottom surface 46 of the base 12 of the first bin 10. The flanges 44 are represented in FIGS. 4, 5, 8 and 9. As represented in FIG. 4, the arcuate flanges 44 are arranged in a circle that extends downward from the bottom surface 46 of the base 14 of the bin 10. The circle defined by the arcuate flange is 44 is centered on the bottom surface 46 of the base 14.

A first support 52 is connected to the first bin 10. The first support has a general rectangular configuration. The support 52 has a top surface 54 and an opposite bottom surface 8. The support 52 has a circular rim 58 around a hole through the center of the support 52. As represented in FIG. 4, the rim 58 is dimensioned to receive the arcuate flanges 44 of the bin 10 inside the rim 58 when connecting the support 52 to the bin 10. With the bin 10 being constructed of a plastic material, the arcuate flanges 44 are resiliently flexible and snap into the hole defined by the rim 58 when connecting the support 52 to the bin 10. The engagement of the arcuate flanges 44 inside the rim 58 attaches the support 52 to the bin 10 enabling the support 52 to be alternatively positioned on the bin 10 in at least a first position of the support 52 on the bin 10 represented in FIGS. 2, 4, 5, 6 and 7, and a second position of the support 52 on the bin 10 represented in FIGS. 1, 8, 9 and 10. The engagement of the arcuate flanges 44 inside the rim 58 also connects the support 52 to the bin 10 for movement of the support 52 on the bin 10 or rotation of the support 52 on the bin 10 between the first and second positions of the support 52 on the bin 10.

The top surface 54 of the first support 52 is a flat, planar surface that engages in sliding engagement with the bottom surface 46 of the base 14 of the first bin 10. The engagement of the top surface 54 of the support 52 on the bottom surface 46 of the base 14 and the connection of the rim 58 with the arcuate flanges 44 enables the support 52 to be rotated on the bin 10 between the first and second positions of the support 52 relative to the bin 10.

The rectangular configuration of the first support 52 is defined by the support 52 having a longitudinal length dimension between a first end edge 62 of the support 52 and an opposite second end edge 64 of the support. The support 52 has a lateral width dimension between a first side edge 66 of the support 52 and an opposite second side edge 68 of the support. Together, the first end edge 62, the second end edge 64, the first side edge 66 and the second side edge 68 of the support 52 define the rectangular configuration of the support. The longitudinal length dimension of the support between the first end edge 62 and the second end edge 64 is larger than the lateral width dimension of the support 52 between the first side edge 66 and the second side edge 68 of the support. The longitudinal length dimension of the support 52 is also smaller than the longitudinal length dimension of the base 14 of the bin 10, and larger than the lateral width dimension of the base 14.

A first end flange 72 extends downward from the first end edge 62 of the support 52. On the opposite end of the support 52, a second end edge flange 74 extends downward from the second end edge 64 of the support. The first end flange 72 and the second end flange 74 have interior surfaces that oppose each other and are directed toward the center of the support 52 defined by the rim 58. With the support 52 constructed of a plastic material, the first end flange 72 and the second end flange 74 are resiliently flexible.

As represented in FIG. 1, the first end flange 72 has portions 76 that are positioned inward toward the center of the support 52 defined by the rim 58. The second end flange 74 is constructed with the same inward positioned portions 78.

As represented in FIG. 4, a pair of lock tabs 82 project inward toward the center of the support 52 from the interior surfaces of each of the first end flange portions 76. There is also a pair of lock tabs 84 that projected inward from the interior surfaces of each of the second end flange portions 78.

A pair of first posts 86 extend downward from the bottom surface 56 of the support 52. As represented in FIG. 4, the pair of first posts 86 are spaced inward from the interior surfaces of the first end flange portions 76 and from the first end flange lock tabs 82. A second pair of posts 88 extends downward from the bottom surface 56 of the support 52. As represented in FIG. 4, the second pair of posts 88 are spaced inward from the interior surfaces of the second end flange portions 78 and from the second lock tabs 84.

The storage apparatus also comprises a second support 52' that is connectable to the second bin 12. The second support 52' has the same construction and functioning as the first support 52, and therefore is not specifically described herein As stated earlier, the first support 52 can be connected to the first bin 10 in a first position of the support 52 on the bin 10, and a second position of the support 52 on the bin 10. The first support could be connected stationary in the first or second positions on the first bin. However, the support 52 is connected to the bin 10 to be rotatable relative to the bin 10 between the first and second positions. FIGS. 2, 4, 5, 6 and 7 represent the support 52 in the first position relative to the bin 10. In this position of the support 52, the longitudinal length of the support 52 does not extend beyond the longitudinal length of the base 14 of the bin 10 and the lateral width dimension of the support 52 does not extend beyond the lateral width dimension of the base 14. This enables the first support 52 and the first bin 10 to be insertable together into the interior volume of the second bin 12 when nesting the first bin 10 inside the second bin 12.

The first support 52 in the second position of the support 52 relative to the bin 10 is represented in FIGS. 1, 8, 9 and 10. In the second position of the first support 52 on the first bin 10, the first support 52 is positioned transverse to the base 14 of the first bin 10 with the longitudinal length dimension of the first support 52 extending beyond the lateral width dimension of the first base 14. This positions the first end flange 76 and the second end flange 74 of the first support 52 outside the lateral width dimension of the first bin 10. In this position of the first support 52 on the first bin 10, the first support 52 can be engaged on the top of the first sidewall 22' and second sidewall 24' of the second bin 12. In this position, the first support 52 supports the first bin 10 on the second bin 12.

Additionally, with the first support 52 in the second position relative to the first bin 10, the first support 52 can be pressed downwardly onto the tops of the first sidewall 22' and the second sidewall 24' of the second bin 12. This causes the first end flange 72 of the first support 52 to pass downward over the notches on the first side wall 22' of the second bin 12, and causes the second end flange 74 of the first support 52 to pass over the notches on the second side wall 24' of the second bin 12. The first bin 10 together with the first support 52 can be continued to be moved downwardly on to the tops of the first sidewall 22' and second sidewall 24' of the second bin 12 until the lock tabs 82 on the first end flange 72 of the first support 52 engage beneath the bottom edges 32' of the first notches on the first side wall 22' of the second bin 12, and until the lock tabs 84 on the second end flange 74 of the first support 52 engage beneath the bottom edges of the second notches in the second sidewall 24' of the second bin 12. The engagement of the lock tabs beneath the bottom edges of the notches in the sidewalls attaches the first support 52 on the first bin 10 to the tops of the sidewalls 22', 24' of the second bid 12, and thereby attaches the first bin 10 to the second bin 12. The attachment of the first bin 10 to the second bin 12 enables both the first bin 10 and the second bin 12 to be transported together when moving the bins.

As represented in FIGS. 2-9 and 10, a handle 92 is removably attachable to the first bin 10. The handle 92 could also be removably attached to the second bin 12. The handle 92 has opposite ends with pivot pins 94, 96 that extend inward toward each other. The pivot pins 94, 96 are engageable into the pivot holes 38, 42 in attaching the handle 92 to the first bin 10. With the handle 92 attached to the first bin 10, the handle 92 is movable to lift and move the first bin 10 enabling the first bin 10 and the second bin 12 attached to the first bin to be moved together when the first support 52 on the first bin 10 is attached to the second bin 12 as represented in FIGS. 9 and 10. The handle 92 can be removed from a bottom bin or the second bin 12 as represented in FIGS. 9 and 10 when stacking the first bin 10 on the second bin 12, or when nesting the first bin 10 in the second bin 12.

In view of the above, it will be seen that the several objects and advantages of the present invention have been achieved and other advantageous results have been obtained.

As various changes could be made in the above constructions of the storage apparatus having stackable nested bins without departing from the scope of the invention, it is intended that all matter contained in the above description or shown in the accompanying drawings shall be interpreted as illustrative and not in a limiting sense.

The invention claimed is:

1. A storage apparatus comprising:

a first bin, the first bin having a rectangular configuration;

a support on the first bin;

a second bin, the second bin having a rectangular configuration; and the support on the first bin being alternatively positioned on the first bin in at least a first position of the support on the first bin and a second position of the support on the first bin, in the first position of the support on the first bin the support and the first bin are insertable into the second bin, and in the second position of the support on the first bin the support is engageable on top of the second bin and supports the first bin on top of the second bin.

2. The storage apparatus of claim 1, further comprising:

the first bin having a first configuration;

the second bin having a second configuration; and the first configuration and the second configuration match.

3. The storage apparatus of claim 1, further comprising:

the first bin having a base and at least one wall extending upward from the base and around an interior volume of the first bin;

the second bin having a base and at least one wall extending upward from the base and around an interior volume of the second bin; and the support being engageable on top of the at least one wall of the second bin with the support supporting the first bin on top of the at least one wall of the second bin over the interior volume of the second bin.

4. The storage apparatus of claim 1, further comprising:

the first bin having a base, a front wall and an opposite back wall extending upward from the base, and a first side wall and an opposite second side wall extending upward from the base, the front wall, the back wall, the first side wall and the second side wall being relatively positioned in a rectangular configuration;

the second bin having a base, a front wall and an opposite back wall extending upward from the base, and a first side wall and an opposite second side wall extending upward from the base, the front wall, the back wall, the first side wall and the second side wall being relatively positioned in a rectangular configuration; and the support on the first bin is engageable on top of the first sidewall and the second side wall of the second bin with the support extending over an interior volume of the second bin and supporting the first bin on top of the second bin.

5. The storage apparatus of claim 1, further comprising:

the support is movable on the base of the first bin between the first position of the support on the first bin and the second position of the support on the first bin.

6. The storage apparatus of claim 1, further comprising:

the support is a first support;

a second support on the second bin;

the second support on the second bin is movable between first and second positions of the second support on the second bin, in the first position of the second support on the second bin the second support and the second bin are insertable into the first bin, and in the second position of the second support on the second bin the second support is engageable on top of the first bin and supports the second bin on top of the first bin.

7. The storage apparatus of claim 1, further comprising:

in the second position of the support on the first bin, the support is attachable on top of the second bin enabling the first bin and the second bin attached to the first bin to be lifted together by lifting the first bin and moved together.

8. The storage apparatus of claim 7, further comprising:

a handle on the first bin, the handle being manually movable upward enabling the first bin and the second bin attached to the first bin to be manually moved upward together when the support is attached on top of the second bin.

9. The storage apparatus of claim 1, further comprising:

attachment devices extending downward from the support; and in the second position of the support on the first bin the attachment devices are attachable on top of the second bin thereby attaching the first bin to the second bin and enabling the first bin and the second bin to be moved together.

10. The storage apparatus of claim 1, further comprising:

the support is a first support;

a second support on the second bin;

the second support on the second bin being alternatively positioned on the second bin in at least a first position of the second support on the second bin and a second position of the second support on the second bin, in the first position of the second support on the second bin the second support and the second bin are insertable into the first bin, and in the second position of the second support on the second bin the second support is engageable on top of the first bin and supports the second bin on top of the first bin.

11. The storage apparatus of claim 10, further comprising:

a third bin;

a third support on the third bin;

the third support on the third bin being alternatively positioned on the third bin in at least a first position of the third support on the third bin and a second position of the third support on the third bin, in the first position of the third support on the third bin the third support and the third bin are insertable into the second bin and into the first bin, and in the second position of the third support on the third bin the third support is engageable on top of the first bin and supports the third bin on top of the first bin, and the third support is engageable on top of the second bin and supports the third bin on top of the second bin.

12. A storage apparatus comprising:

a first bin, the first bin having a rectangular configuration and an interior volume and a top opening to the interior volume;

a support on the first bin;

a second bin, the second bin having a rectangular configuration and an interior volume and a top opening to the interior volume; and the support on the first bin being alternatively positioned on the first bin in at least a first position of the support on the first bin and a second position of the support on the first bin, in the first position of the support on the first bin the support and the first bin are insertable together through the top opening of the second bin and into the interior volume of the second bin, and in the second position of the support on the first bin the support is attachable on top of the second bin and supports the first bin on top of the second bin and enables the first bin and the second bin attached to the first bin to be moved together.

13. The storage apparatus of claim 12, further comprising:

the first bin having a base and at least one wall extending upward from the base and around the interior volume of the first bin;

the second bin having a base and at least one wall extending upward from the base and around the interior volume of the second bin; and the support being attachable on top of at least one wall of the second bin.

14. The storage apparatus of claim 12, further comprising:

the support is rotatable on the first bin between the first position of the support on the first bin and the second position of the support on the first bin.

15. The storage apparatus of claim 12, further comprising:
the support is a first support;
a second support on the second bin;
the second support on the second bin being alternatively positioned on the second bin in at least a first position of the second support on the second bin and a second position of the second support on the second bin, in the first position of the second support on the second bin the second support and the second bin are insertable together through the top opening of the first bin and into the interior volume of the first bin, and in the second position of the second support on the second bin the second support is attachable on top of the first bin and supports the second bin on top of the first bin and enables the second bin and the first bin attached to the second bin to be moved together.

16. The storage apparatus of claim 12, further comprising:
a handle on the first bin, the handle extending over the top opening of the first bin and over the interior volume of the first bin, the handle being movable enabling the first bin and the second bin attached to the first bin to be moved together.

17. The storage apparatus of claim 12, further comprising:
attachment devices extending downward from the support; and
in the second position of the support on the first bin the attachment devices are attachable on top of the second bin thereby attaching the first bin to the second bin and enabling the first bin and the second bin to be moved together.

18. A storage apparatus comprising:
a bin, the bin having a rectangular configuration and a base on the bottom of a bin;
a support on the base of the bin, the support being alternatively positioned on the base of the bin in at least a first position of the support on the base of the bin and a second position of the support on the base of the bin, in the first position of the support on the base of the bin the support and the bin are insertable together into an interior volume of a second bin having a rectangular configuration; and
in the second position of the support on the base of the bin the support is engageable on top of the second bin to support the bin on top of the second bin.

19. The storage apparatus of claim 18, further comprising:
in the second position of the support on the base of the bin the support is attachable on top of the second bin to attach the bin on the second bin.

20. The storage apparatus of claim 18, further comprising:
attachment devices extending downward from the support; and
in the second position of the support on the base of the bin, the attachment devices are attachable on top of the second bin thereby attaching the bin to the second bin and enabling the bin and the second bin to be moved together.

* * * * *